United States Patent [19]

Ozaltay

[11] 4,274,341

[45] Jun. 23, 1981

[54] COAL GASIFYING BURNER WITH ROTATING GRILL

[76] Inventor: Huseyin C. Ozaltay, Kucukesat Caddesi, 55/13, Ankara, Turkey

[21] Appl. No.: 65,877

[22] Filed: Aug. 13, 1979

[30] Foreign Application Priority Data

Dec. 7, 1978 [TR] Turkey ..... 101848

[51] Int. Cl.[3] ..... F23K 1/00; C10J 1/00

[52] U.S. Cl. ..... 110/229; 110/230; 122/5; 48/77

[58] Field of Search ..... 110/229, 230, 231, 218, 110/245; 122/5; 48/77; 432/97, 101

[56] References Cited

U.S. PATENT DOCUMENTS

| | | | |
|---|---|---|---|
| 514,994 | 2/1894 | Hutchinson et al. | 110/229 |
| 1,023,567 | 4/1912 | Huttinger | 122/5 |
| 1,897,950 | 2/1933 | Battin et al. | 122/5 |
| 2,071,678 | 2/1937 | Bellay | 122/5 |
| 2,147,324 | 2/1939 | Ackeren | 110/229 |
| 2,488,969 | 11/1949 | Dietler | 110/229 |
| 2,788,961 | 4/1957 | Pooley et al. | 432/101 |
| 3,277,945 | 11/1966 | Vermes | 110/230 |

*Primary Examiner*—Henry C. Yuen

*Attorney, Agent, or Firm*—Maky, Renner, Otto & Boisselle

[57] ABSTRACT

A coal gasifying burner characterized by a rotating grill which is composed of grill disks arranged on two pipes with a narrow gap between the grills and which rotates very slowly inwards when viewed from the top sloped side walls made of metal sheet having a sloper compatible with coal flow, a cylindrical jacket placed around the periphery of the nozzle which delivers combustion air to the burner, gasification of a quantity of coal located on the sloping side walls around a narrow area where coal combustion takes place, and combustion of the generated coal gas outside of the burner by secondary air which cools the system and gets heated itself by the coal cooking process.

7 Claims, 3 Drawing Figures

Fig.4
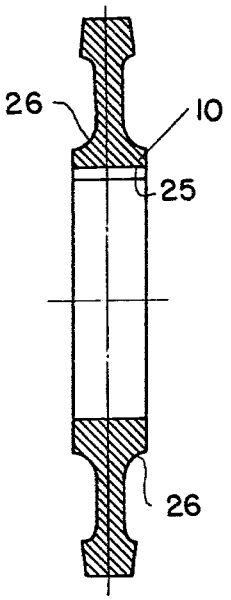
Fig. 3
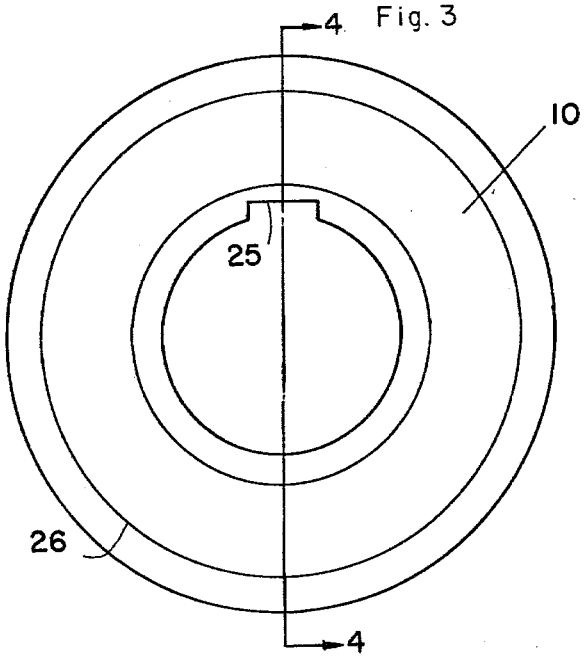
Fig.5
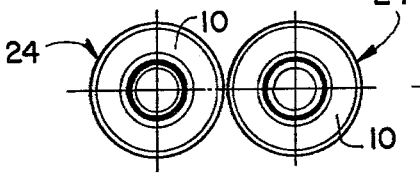
Fig.6
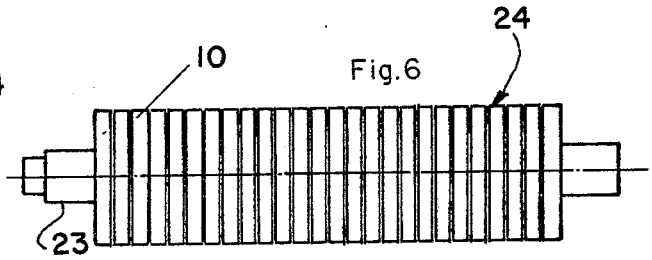
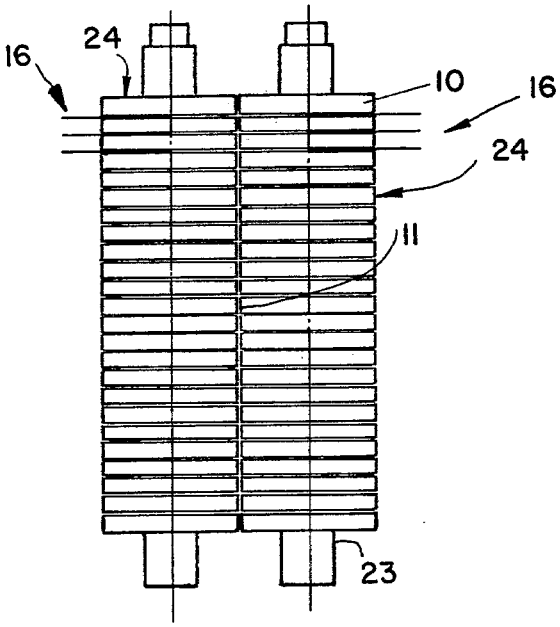
Fig.7

COAL GASIFYING BURNER WITH ROTATING GRILL

This invention concerns a coal gasifying burner which contains a rotating grill to enable the efficient combustion of bitimunous coal and lignites.

The main object of this invention is to enable the combustion of coal automatically and with high efficiency.

The principal presented to obtain the main object of the invention is to burn the coal on a narrow and rotating grill and thus cause the generation of gas from the abundant quantity of coal at the sides of the rotating grill. Later the generated coal gas is to be burnt outside of the burner by air previously employed to cool the cumbustion chamber, such air being heated during the cooling process. To the fulfillment of the main object, the burner of the invention comprises: narrow passages through which coal flows from coal storage to combustion cell, air bearing isolation partition which is placed on the roof that separates the combustion cell and the coal storage, sloped side walls of sheet metal having a slope compatible with coal flow, means for cooling by water the parts of the front, back and side walls of the combustion cell where actual burning takes place, rotating grill cylinders which rotate inwardly towards each other when viewed from the top and which are composed of disks arranged on two pipes with a very narrow gap between them, an ash tray with a bottom part and in the shape of a siphon filled with water, steel profiles which connect the ash tray to the body of the burner, a cylindrical jacket placed around the nozzle which delivers the combustion air to the system, and combs which enable the slag between the grills to be cleaned.

To provide a clearer understanding of the invention whose main objects and principles have been set forth above, the coal gasifying burner with rotating grill of the invention is illustrated in the annexed drawings, the figures of which are as follows:

FIG. 3 is a side elevation of one of the disks of the rotating grill;

FIG. 4 is a cross-section of the disk of FIG. 3 taken on the line 4—4 thereof.

FIGS. 5, 6 and 7 are respectably end, side and top views of the rotating grill.

The construction and the method of operation of the coal gasifying burner with rotating grill which is the subject of invention is described below with the aid of figures.

Figure 1:
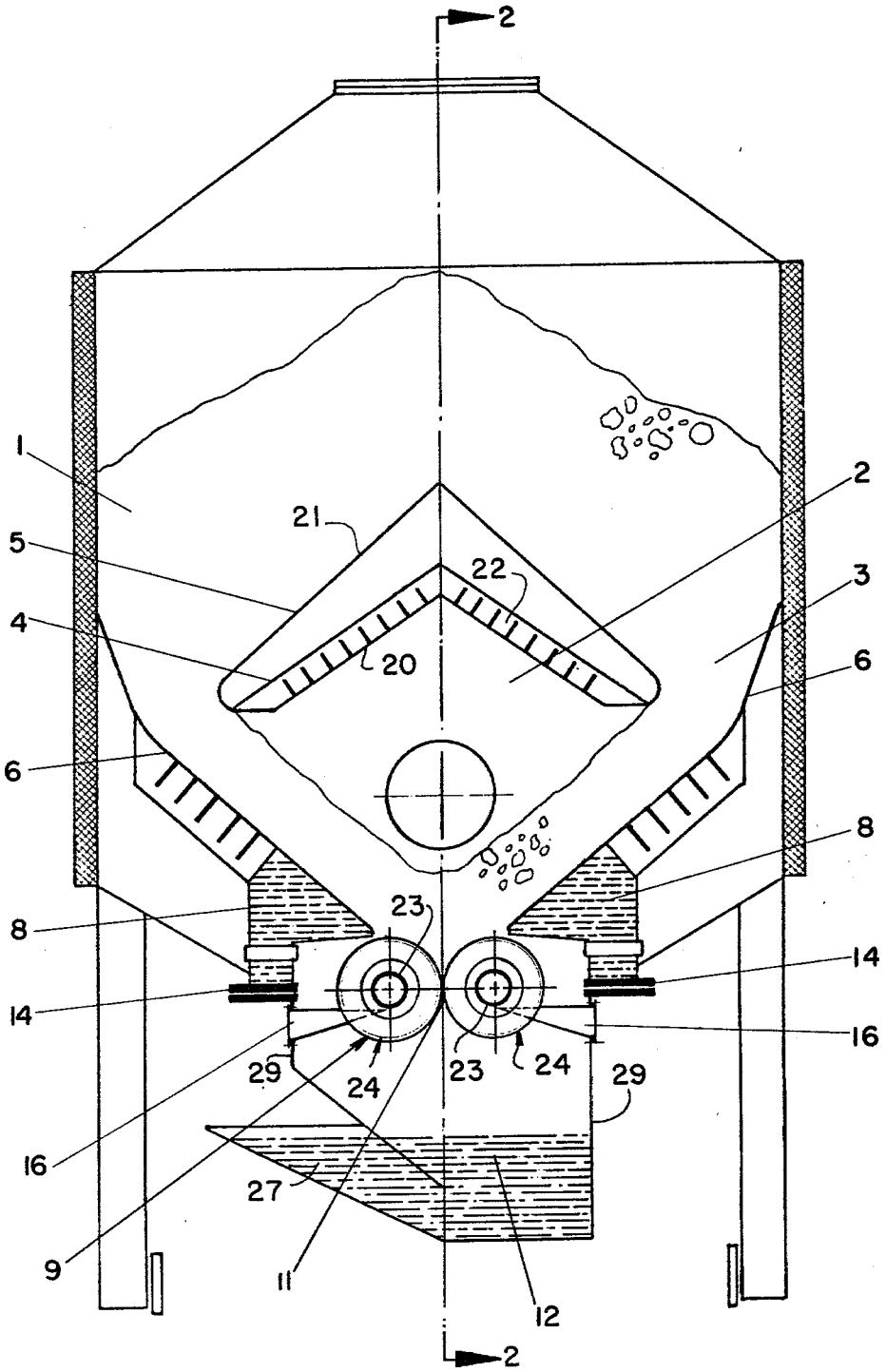
FIG. 1 is a cross-sectional view of the coal gasifying burner with rotating grill.
Figure 2:
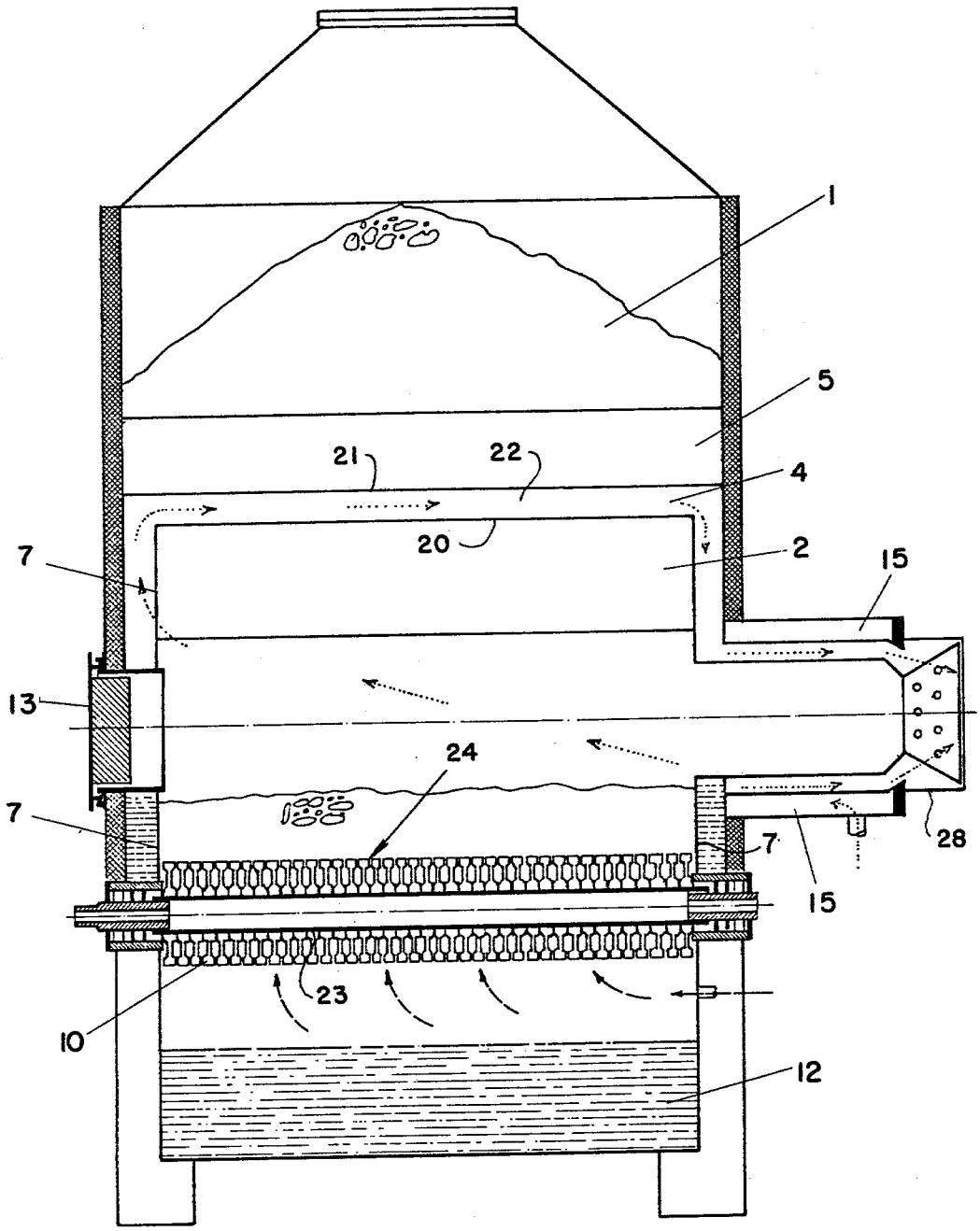
FIG. 2 is a cross-section of the burner of FIG. 1 taken on the line 2—2 thereof.

Referring initially to FIGS. 1 and 2, a burner according to the invention is illustrated. In the burner coal flows from a coal storage (1) which makes up or forms the top of the burner, into a combustion cell (2) through narrow gaps (3) which determine the thickness of the coal layer passing through the combustion cell. The edges of the gaps (3) are rounded to enable continuous coal flow. Due to the gap (3) whose edges are rounded, coal equal in amount to that burnt on a grill (9) flows down from the coal storage (1); by gravity.

A combustion cell roof (4) which separates the combustion cell (2) and the coal storage (1) consists of two layers through which secondary air circulates. It can be seen in FIGS. 1 and 2 that the two layers are in the form of spaced sheets 20 and 21 which together form an air passage 22 through which the secondary air is passed for cooling purposes. As the secondary air cools the roof, it in turn gets heated itself. The heating of the secondary air in turn heats the coal on top edges or sheet 21 of the roof thus causing the evaporation of water and a certain amount of volatile gasses from the coal. This evaporation causes a disturbance in the flow of coal and explosions in the coal storage (1). To prevent such heat transfer from the roof to the coal in the coal storage, an air bearing isolation partition (5) is provided on top of the roof (4).

If the side walls of the combustion cell are lined with fire resisting bricks, it has been observed that coal particles stick to these bricks. This phenomenon disturbs the continuous flow of coal through the burner. Therefore, the side walls (6) of the combustion cell (2) are made with sloping sheet metal compatible with coal flow and use of fire bricks is ommitted. As seen in FIG. 1, the slope of the sheet metal side walls (6) is such that coal is fed by gravity therealong at a substantially constant depth or thickness corresponding generally to that of the gaps (3).

The front and back walls (7) as well as the side walls (6) of the combustion cell (2), in other words the parts where actual burning of the coal takes place and intense heat is generated, are cooled down with water. As seen in FIGS. 1 and 2, a water jacket (8) encircling the combustion cell (2) is provided for cooling purposes.

In order to enable the burner to work automatically by a thermostatic control, the new grill type shown is developed. The grill assembly (9) shown in FIGS. 1 and 2 closes the bottom of the combustion cell between the sloping side walls and consists of a plurality of grill disks (10) arranged on two pipes or shafts (23) to form grill cylinders (24). The pipes (23) are parallel-spaced apart such that the two grill cylinders (24), there is provided a very narrow gap (11) for passage of ash and slag. In FIGS. 3 and 4, the disks can be seen to be relatively thin, each having a key slot (25) for locking same to the pipe for rotation therewith. Moreover, each disk is axially recessed at both sides to provide an annular channel (26) in its sides radially inwardly from its outer edge. The radially outer edge of the disk is shown to have a slight taper, it being narrowest at the disk periphery. The disks are shown assembled on the pipe (23) in FIGS. 5-7. Referring back to FIGS. 1 and 2, when viewed from the top, the grill cylinders (24) rotate very slowly towards each other by commands from the boiler or furnace in which the burner is incorporated. The grill cylinders (24) stop if so commanded. By such a type of grill (9) it becomes possible to provide continuous burning of coal of the same quality without any drop of unburnt coal on to the ash tray (12). Since the ash and slag are automatically dispensed on to the ash tray (12), there is no need to open the lid (13) in front of the burner, except in times of operational problems, to unload ash and slag. Therefore, introduction of cold air into the burner system which reduces the efficiency is avoided.

The ash tray (12) which is located below the grill (9) and forms a closed chamber beneath the grill for receipt of ash and slag, is attached to the body of the burner by steel profiles (14). Thus, the grill assembly (9) can easly be taken out for maintenance and repair work.

The bottom of the ash tray (12) which is filled with water, is siphon shape. As best seen in FIG. 1, the siphon leg (27) is open at its upper end thereby providing access into the ash tray. Thus, ash and slag can be taken out of the ash tray (12) without introducing cold air which cools down the burner system causing a decrease in its efficiency.

Combustion air is delivered to the burner system by a cylinder (15) fitted around the burner nozzle (28), after which is divided in two as primary and secondary air. By introducing the initial air around the nozzle periphery, the heat loss from the nozzle is again returned to the system, thus increasing burner efficiency.

As seen in FIG. 1, combs (16) designed to fit between the disks of the grill cylinders are mounted on the grill assembly (9) to clean the slag left between the grill cylinders. Long holes are drilled into the sides (29) of the ash tray to permit maintenance and repair work on the combs which are connected to the ash tray by steel profiles.

As can clearly be understood from the explanations given above, the coal gasifying burner with rotating grill cylinders can be operated automatically and with an efficiency (85–90%) as high as a fuel oil burner and with even less pollution (quantity of smoke measured in the chimney is Bacharach 0–3).

Following the figures and specifications presented, the coal gasifying burner with rotating grill assembly can be utilized with capacities for heating purposes of the smallest apartment flat (100000 kcal/h) as well as the biggest industrial complexes (20,25000000 kcal/h).

What I claim is:

1. A coal gasifying burner comprising a coal storage, a combustion cell positioned beneath said coal storage, narrow gap means with rounded edges through which coal flows continuously from said coal storage to said combustion cell, a roof for said combustion cell separating said combustion cell from said coal storage, an air bearing insulation partition placed on said roof for separating the coal in said coal storage from said roof, sloping side walls made of sheet metal having slopes compatible with coal flow, a nozzle for burning coal gas generated by burning coal in said combustion cell, a jacket surrounding said nozzle, and secondary air means connected to said jacket for cooling said roof and for supporting combustion of coal gas at said burner, whereby gasification is obtained of an abundance of coal located on said sloping side wall around a narrow area where coal combustion takes place, and combustion of the generated gas outside of the burner at said nozzle by secondary air which previously cooled the roof and thus gets heated itself by the cooling process.

2. The coal gasifying burner of claim 1 further comprising a grill assembly at the bottom of said combustion cell which includes a plurality of grill disks arranged on two pipes with a narrow gap between the opposed disks of each pipe, said disks being rotatable very slowly inwardly when viewed from the top for maintaining a continuous and same quality combustion in said combustion cell, and comb means for cleaning slag from between the grill disks.

3. The coal gasifying burner of claim 2 wherein each disk has in each side thereof an annular groove.

4. The coal gasifying burner of claim 2 wherein said comb means comprises a plurality of combs fitted between adjacent disks of each pipe.

5. The coal gasifying burner of claim 2 wherein said narrow gap means is formed between said roof and said sidewalls of said combustion cell.

6. The coal gasifying burner of claim 2 further comprising cooling means for said sloping sidewalls.

7. The coal gasifying burner of claim 2 further comprising a fluid filled ash tray of siphon shape for receipt of ash and slag from said grill assembly and removal of ash and slag from said ash tray through the siphon leg thereof.

* * * * *